United States Patent [19]

Meade

[11] Patent Number: 4,649,764

[45] Date of Patent: Mar. 17, 1987

[54] HOIST ELEVATING MEANS

[75] Inventor: Ronald G. Meade, Edwardstown, Australia

[73] Assignee: Hills Industries Limited, Edwardstown, Australia

[21] Appl. No.: 771,251

[22] Filed: Aug. 30, 1985

[30] Foreign Application Priority Data

Aug. 31, 1984 [AU] Australia ..... PG6874

[51] Int. Cl.[4] ..... F16H 27/02

[52] U.S. Cl. ..... 74/89.15; 74/424.8 R

[58] Field of Search ..... 74/89.15, 424.8 R; 254/103

[56] References Cited

U.S. PATENT DOCUMENTS

| | | | |
|---|---|---|---|
| 1,071,213 | 8/1913 | Crabb | 74/424.8 R |
| 3,798,984 | 3/1974 | McMinn | 74/89.15 |
| 3,824,905 | 7/1974 | Jablonsky | 74/89.15 X |
| 4,236,419 | 12/1980 | Calvert | 74/89.15 |
| 4,483,515 | 11/1984 | Maryonovich | 254/103 |
| 4,485,690 | 12/1984 | Lipinski et al. | 74/429.8 R X |
| 4,512,208 | 4/1985 | Lipinski et al. | 74/89.15 |

*Primary Examiner*—Cornelius J. Husar
*Assistant Examiner*—Nancy J. Stodola
*Attorney, Agent, or Firm*—Henry Sternberg; Bert J. Lewen

[57] ABSTRACT

A clothes hoist comprising a bearing block secured to the outer surface of the fixed lower standard of a clothes hoist but having an annular projection which extends through an aperture in the wall of the lower standard and into an aperture in the side wall of a tubular inner member to thereby support the tubular inner member, the tubular inner member itself supporting a nut which threadably engages a non-circular threaded stem which, upon rotation of the nut, raises or lowers the upper standard. Rotation is effected by rotating a handle on the end of a driving pinion skirt journalled in the bearing block, and having a driving pinion on its inner end which meshes with a driven pinion on the nut. A body surrounds the lower standard and overlies an outwardly projecting portion of the bearing block.

7 Claims, 3 Drawing Figures

HOIST ELEVATING MEANS

This invention relates to elevating means for the elevating of the upper standard of a clothes hoist of the type which is used for the drying of clothes.

BACKGROUND OF THE INVENTION

Hoist elevating means quite often incorporate a handle on the outer end of a skirt the inner end of which carries a pinion within the lower standard of a hoist, the pinion driving a driven pinion carried on one end of a nut which is itself supported by a thrust washer, and the nut engages the threads of a flat sided threaded stem which is non-rotationally movable within the hoist, the flat sides engaging corresponding surfaces in an inner member within the hoist. Our Australian Patent No. 506,744 (or corresponding U.S. Pat. No. 4,236,419 or British Patent No. 1,544,071) includes a description of such an arrangement.

Clothes hoists constructed in accordance with the above specifications have been used extensively and are very satisfactory. Ingress of moisture was inhibited, but not entirely prevented, and one object of this invention is to provide improvements whereby ingress of moisture is still further inhibited. Another object is to provide elevating means which embody still further mechanical improvements for the support of the upper standard wherein the axial load thereof can be transferred to a bearing block for a handle skirt, which block is supported by the wall of the lower standard.

BRIEF SUMMARY OF THE INVENTION

In this invention, a bearing block is secured to the outer surface of the fixed lower standard of a clothes hoist but has an annular projection which extends through an aperture in the wall of the lower standard and into an aperture in the side wall of a tubular inner member to thereby support the tubular inner member, the tubular inner member itself supporting a nut which threadably engages a non-circular threaded stem which, upon rotation of the nut, raises or lowers the upper standard. Rotation is effected by rotating a handle on the end of a driving pinion skirt journalled in the bearing block, and having a driving pinion on its inner end which meshes with a driven pinion on the nut. A body surrounds the lower standard and overlies an outwardly projecting portion of the bearing block.

This arrangement improves water shed, and is mechanically so strong that the tubular inner member, bearing block, pinions, skirt, nut and threaded stem can all be formed of polymeric material, with a consequential cost saving.

More specifically, the invention consists of elevating means which comprise an tubular inner member arranged to be contiguous with the inner surface of the lower standard, and having an aperture surface defining an aperture extending through its side wall, a bearing block secured to the outer surface of the lower standard but having an annular projection which extends through the wall of the lower standard and into said aperture and engages the surface thereof and thereby supports the tubular inner member against axial and rotational displacement, a body surrounding the lower standard and overlying an outwardly projecting portion of the bearing block, a driving pinion having a skirt supported for rotation by a bearing surface in the bearing block, and a handle on the outer end of the skirt, a driven pinion meshing with the driving pinion said driven pinion being supported for both rotation and axial thrust by a bearing surface within the tubular inner member, the driving pinion comprising a nut and having an inner threaded surface, a non-circular threaded stem slidable through a correspondingly non-circular aperture in said lower end of the tubular inner member and restrained against rotational movement by the non-circular surface defining that aperture, the thread of said stem being engaged by the inner threaded surface of the nut such that rotation of the handle effects rotation of the nut and in turn raises or lowers the threaded stem, and standard support means on the upper end of the threaded stem supporting the upper standard.

DETAILED DESCRIPTION OF THE DRAWINGS

An embodiment of the invention is described hereunder in some detail with reference to, and as illustrated in the accompanying drawings, in which.

Figure 1:
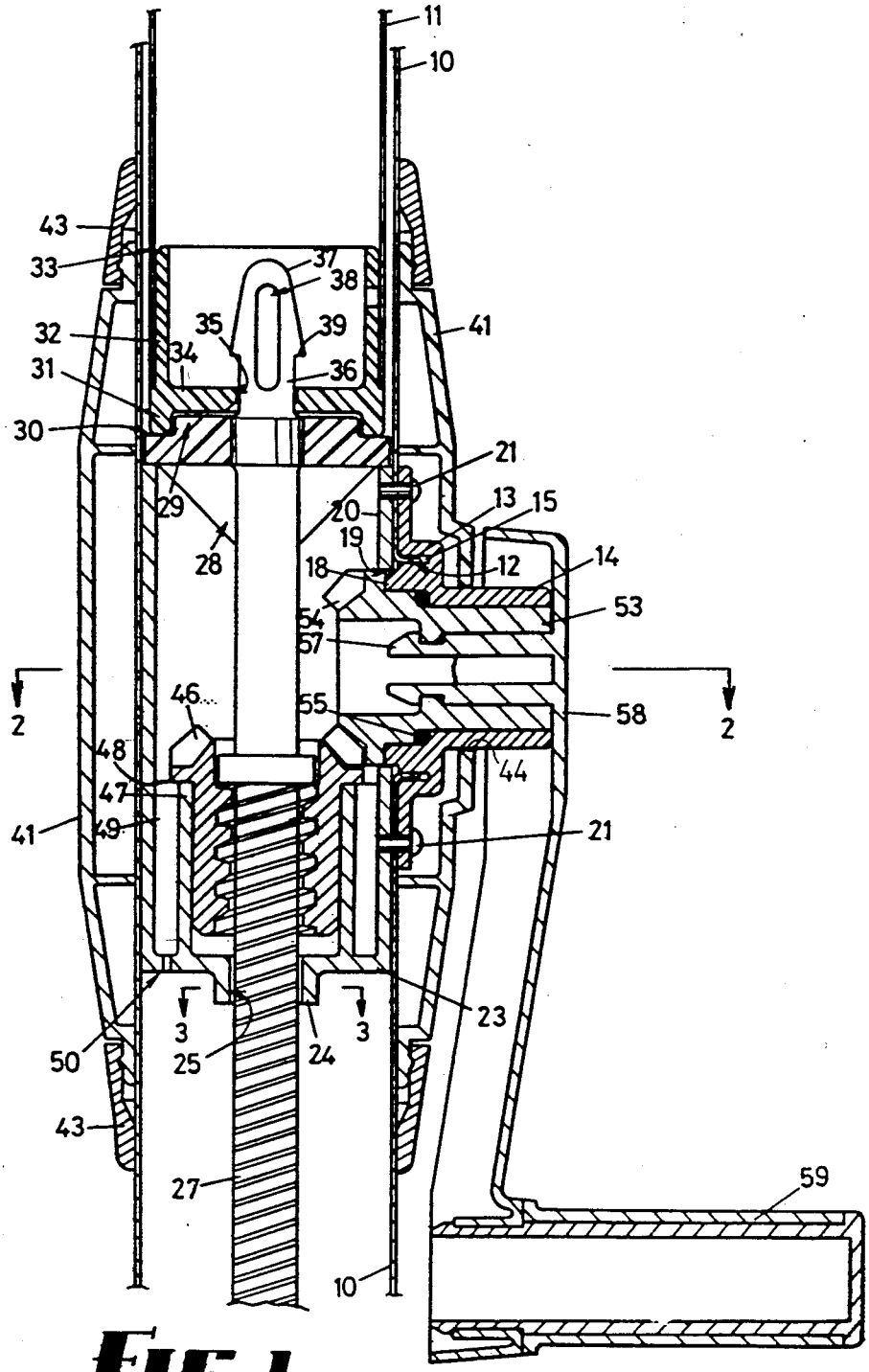
FIG. 1 is a central elevational section through the elevating means.
Figure 2:
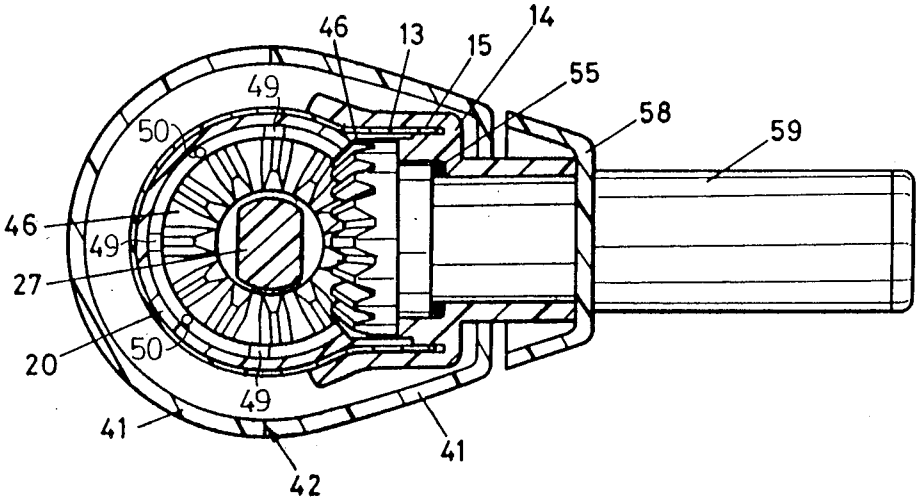
FIG. 2 is a plan section on line 2—2 of FIG. 1.

In this embodiment a rotary clothes hoist comprises a fixed tubular lower standard 10 and an upper tubular standard 11 which is an elevating standard and is telescopically movable within the upper end of the lower standard 10.

The lower standard 10 is provided with an aperture 12 intermediate its ends, and the metal surrounding the aperture is deformed outwardly to provide a circular skirt-like flange 13 which projects outwardly from the lower standard.

A bearing block 14 is formed from polymeric material and has an annular slot 15 intermediate its ends, which contains the flange 13, so that the flange accurately locates and also physically supports the bearing block 14. The bearing block 14 has an inner extension 18 which engages the surface of an aperture 19 within a tubular inner member which is contained within, and contiguous with the inner walls of, the lower standard 10. By this means the position of the tubular inner member 20 is fixed, and the tubular inner member 20 and the bearing block 14 are secured together and also secured to the lower standard by means of a pair of fasteners 21.

Figure 3:
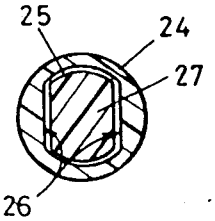
FIG. 3 is a plan section on line 3—3 of FIG. 1.

The tubular inner member 20 is a cup-like member, the lower end of which comprises an annular portion 23 with a depending skirt 24, the depending skirt 24 surrounding an aperture 25 which is part circular but which has two flat sides 26, as illustrated in FIG. 3. A threaded stem 27 has flat sides and thereby is a flat sided worm axially movable but not rotational within the aperture 25 due to engagement of the flat sides 26. The upper end of the flat sided stem 27 terminates in a base cross 28 which extends across most but not all of the diameter of the space within the lower standard 10, and the upper surface of the base cross is provided with an upwardly projecting spigot 29 defined by circular walls which define a shoulder 30 which is engaged by an annular ring portion 31 of a support cup 32. The outer surface of the support cup 32 has a slightly reduced diameter portion 33 extending part way down its outer surface terminating in a small shoulder, which supports the lower end of the elevating standard 11, and a cup base 34 of support cup 32 contains a central aperture 35 which receives a barbed spigot 36 upstanding from the base cross 28, the arrangement being such that driving the barbed spigot 36 into the support cup base 34 interlocks the flat sided threaded stem 27 with the support cup 32, but the central aperture 35 through which the barbed portion projects is circular so that the support cup 32 can freely rotate on the base cross 28, which thereby forms a thrust bearing. The head 37 of the barbed spigot 36 contains a closed ended slot 38 between the barb shoulders 39 so that there is little danger of ageing of the plastics material causing sufficient distortion to allow the support cup to lift away from the threaded stem, for example, under windy conditions.

Surrounding the portion of the lower standard which contains the elevating mechanism is a body 41, the body comprising two body portions which are co-operable with one another across a diametral plane 42, and are retained in their assembled condition by upper and lower retaining sleeves 43 which resiliently deform upon engagement and snap back into position. The body overlies the bearing block 14 but has an aperture 44 which surrounds the bearing block, and is thereby retained against axial rotational movement by the bearing block 14. It also sheds water away from the bearing block.

The flat sided stem 27 is engaged by the threads of a driven pinion 46 which is contained within a cup-like bearing 47 upstanding from the annular portion 23 of the tubular inner member 20, the upper end of the bearing being an annular planar surface and this is engaged by an outstanding thrust shoulder 48 of the driven pinion such that the upward thrust imparted upon driving of the driven pinion 46, which results in elevation of the elevating standard 11, is borne by the thrust surfaces between the thrust shoulder and the annular upper surface of the bearing. The bearing 47 is spaced radially inwardly from the inner wall of the inner tubular member and is connected thereto by a plurality of webs 49, and between those webs are located drain apertures 50 for draining any water (for example, condensate) which enters the hoist.

The bearing block 14 which is supported by the flange 13 of the lower standard 10 has a horizontal main axis, and a skirt 53 of a driving pinion 54 is rotational within the bearing block 14. The driving pinion 54 meshes with the driven pinion 46 so that rotation of the driving pinion 54 causes elevation or lowering of the upper standard 11. An "O" ring 55 further inhibits ingress of water. The skirt 53 is interengaged by a barbed bifurcate bar 57 projecting inwardly from the central portion of a handle arm 58, the handle arm extending radially outwardly and terminating in an outstanding handle 59 having a rotational sleeve thereon.

All the elements apart from the upper and lower standards and the "O" ring which have been described herein are formed from polymeric material, mostly from a material having good bearing characteristics (for example, nylon) so that there is no need for the article to be provided with lubricants. Because the load of the upper standard 11 is transmitted through the threaded stem 27, tubular inner member 20 and bearing block 14 to flange 13, there is ample mechanical strength.

By use of moulded elements, the cost has been reduced to be less than the cost of producing a product in accordance with the said Australian Patent No. 506,744, but the quality has been substantially increased and a very reliable and useful elevating means has been provided by this invention, wherein ingress of moisture is substantially inhibited.

The claims defining the invention are as follows;

I claim:

1. Elevating means for elevating an upper tubular standard with respect to a lower tubular standard of a clothes hoist of the type used for drying clothes, comprising a tubular inner member arranged to be contiguous with the inner surface of the lower standard, an aperture surface defining an aperture extending through a side wall of said tubular inner member, a bearing block secured to the outer surface of the lower standard but having an annular projection which extends through the wall of the lower standard and into said aperture and engages the surface thereof and thereby supports the tubular inner member against axial and rotational displacement, a body surrounding the lower standard and overlying an outwardly projecting portion of the bearing block, a driving pinion having a skirt supported for rotation by a bearing surface in the bearing block, and a handle on the outer end of the skirt, a driven pinion meshing with the driving pinion, said driven pinion being supported for both rotation and axial thrust by a bearing surface in the lower end of the tubular inner member, the driven pinion comprising a nut and having an inner threaded surface, a non-circular threaded stem slidable through a correspondingly non-circular aperture in said lower end of the tubular inner member and restrained against rotational movement by the non-circular surface defining that aperture, the thread of said stem being engaged by the inner threaded surface of the nut such that rotation of the handle effects rotation of the nut and in turn raises or lowers the threaded stem, and standard support means on the upper end of the threaded stem supporting the upper standard.

2. Elevating means according to claim 1 wherein said tubular inner member is a cup-like member having an annular portion near its lower end, said driven pinion bearing surface being a surface of the tubular inner member upstanding from the annular portion, and a skirt depending from the lower portion, the skirt having a part circular aperture with two flat sides, said non-circular threaded stem comprising a flat sided worm, the flat sides of which engage the flat sides of the skirt aperture and restrain rotation of the threaded stem but permit axial movement thereof through the skirt.

3. Elevating means according to claim 1 wherein the standard support means comprises an annular shoulder on the upper end of said threaded stem, and further comprising a support cup fixed to the lower end of the upper tubular standard which bears on the annular shoulder and is supported thereby.

4. Elevating means according to claim 3 wherein the support cup contains a central aperture, and a barbed head on the upper end of the threaded stem extends through the central aperture, the barbed head having outstanding barb shoulders which inhibit lifting of the cup from the threaded stem, the barbed head also having a closed ended slot located between the barb shoulders.

5. Elevating means according to claim 1 wherein said wall of the lower standard has a circular flange which extends outwardly therefrom, the bearing block having surfaces defining an annular slot which contains said flange.

6. Elevating means according to claim 5 further comprising an "O" ring located between surfaces of the driving pinion skirt and the bearing block inhibiting ingress of moisture into the elevating means.

7. Elevating means according to claim 5 wherein said body comprises two body portions joined together along a diametral plane by upper and lower resilient retaining rings.

* * * * *